US009188296B2

(12) United States Patent
Gommans

(10) Patent No.: US 9,188,296 B2
(45) Date of Patent: Nov. 17, 2015

(54) LIGHT REDIRECTION DEVICE

(71) Applicant: KONINKLIJKE PHILIPS N.V., Eindhoven (NL)

(72) Inventor: Hendrikus Hubertus Petrus Gommans, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/367,532

(22) PCT Filed: Dec. 19, 2012

(86) PCT No.: PCT/IB2012/057475

§ 371 (c)(1),
(2) Date: Jun. 20, 2014

(87) PCT Pub. No.: WO2013/093796

PCT Pub. Date: Jun. 27, 2013

(65) Prior Publication Data

US 2015/0022895 A1 Jan. 22, 2015

Related U.S. Application Data

(60) Provisional application No. 61/578,396, filed on Dec. 21, 2011.

(51) Int. Cl.
*F21V 7/00* (2006.01)
*F21S 11/00* (2006.01)
(Continued)

(52) U.S. Cl.
CPC ..... *F21S 11/007* (2013.01); *F21S 11/002* (2013.01); *F21V 5/00* (2013.01); *F21V 7/00* (2013.01); *F21V 13/04* (2013.01)

(58) Field of Classification Search
CPC ..... F21V 5/002; F21V 5/00; F21V 5/02; F21V 7/00; F21S 11/00; F21S 11/007; F21S 11/002
USPC ..... 359/597
See application file for complete search history.

(56) References Cited

U.S. PATENT DOCUMENTS 4,498,455 A * 2/1985 Gramm ..... 126/569
4,509,825 A 4/1985 Otto et al.
(Continued)

FOREIGN PATENT DOCUMENTS

DE 2936295 A1 3/1981
EP 1072752 A1 1/2001
(Continued)

*Primary Examiner* — Christopher Mahoney
(74) *Attorney, Agent, or Firm* — Yuliya Mathis

(57) ABSTRACT

A device redirects and concentrates direct sunlight into buildings. The device includes: at least one transparent element having a substantially planar top surface in an x-y-plane and a substantially planar bottom surface, wherein the top and bottom surfaces are arranged at an angle with respect to each other around the x-axis; and a light reflector for each transparent element. The light reflector has a reflective surface arranged substantially parallel and adjacent the bottom surface of the transparent element. The reflective surface is spaced apart from the transparent element by a transparent medium having a lower refractive index than the transparent element. Light incident to the device is refracted by each material transition interface and reflected by the reflecting element. By arranging the device substantially perpendicular to direct sunlight at noon, with one of its edges adjacent a building wall or window, the device can redirect and concentrate sunlight into buildings.

20 Claims, 3 Drawing Sheets

(51) Int. Cl.
*F21V 5/00* (2015.01)
*F21V 13/04* (2006.01)

(56) References Cited

U.S. PATENT DOCUMENTS

| | | | | | |
|---|---|---|---|---|---|
| 4,557,565 | A | | 12/1985 | Ruck et al. | |
| 4,783,156 | A | * | 11/1988 | Yokota | 359/736 |
| 5,461,496 | A | * | 10/1995 | Kanada et al. | 359/592 |
| 5,729,387 | A | | 3/1998 | Takahashi et al. | |
| 5,880,886 | A | * | 3/1999 | Milner | 359/599 |
| 6,311,437 | B1 | * | 11/2001 | Lorenz | 52/173.3 |
| 8,873,146 | B2 | * | 10/2014 | Gardiner | 359/592 |
| 2010/0083953 | A1 | | 4/2010 | Lerner | |
| 2012/0033302 | A1 | * | 2/2012 | Suzuki et al. | 359/597 |

FOREIGN PATENT DOCUMENTS

| | | | |
|---|---|---|---|
| JP | 2001060407 | A | 3/2001 |
| WO | 9205334 | A1 | 4/1992 |
| WO | 2009121180 | A1 | 10/2009 |

* cited by examiner

LIGHT REDIRECTION DEVICE

CROSS-REFERENCE TO PRIOR APPLICATIONS

This application is the U.S. National Phase application under 35 U.S.C. §371 of Internarional Application No. PCT/IB12/057475, filed on Dec. 19, 2012, which claims the benefit of [e.g., U.S. Provisional Patent Application No. or European Patent Application No.] 61/578396, filed on Dec. 21, 2011. These applications are hereby incorporated by reference herein.

FIELD OF THE INVENTION

The present invention relates generally to a device for redirecting and focusing daylight into buildings. More particularly, the present invention relates to a light redirection device for redirecting and concentrating direct sunlight into buildings. The invention further relates to a method for redirecting and focusing daylight into buildings.

BACKGROUND OF THE INVENTION

For several reasons it is desirable to use daylight as much as possible for providing lighting inside buildings. One reason is to save electrical energy and thereby save the environment from carbon dioxide, since a lot of, or at the present date, most, of the electrical energy produced in the world comes from some kind of combustion.

Another reason is that daylight is desirable before electrical lighting by humans in most situations. This has been shown in research as well as in observations of human behaviour and the arrangement of office space. Windows that admit daylight in buildings are important for the view and connection they provide with the outdoors. Daylight is also important for its quality, spectral composition, and variability. Indoor daylight is desired to be able to see well, and to experience environmental stimulation. Working long-term in electric lighting may affect health while working by daylight is believed to result in less stress and discomfort. Daylight provides high illuminance and permits excellent colour discrimination and colour rendering. Daylight may, however, also lead to uncomfort due to glare.

It is thus desirable to distribute daylight into buildings as long as glare is avoided. The traditional way to distribute daylight is to have windows of glass, allowing visible daylight to pass through the window and illuminate the room inside the window. If glare is produced by too direct or bright sunlight the traditional way has been to use shades to absorb or reflect some of the incident daylight and thereby reduce the light inside the room. A problem is then that the amount of light that is transmitted into the room often is too small to be sufficient and electrical lighting has to be used as compensation. Another way to reduce glare is to use frosted or structured glass in the window to scatter the incident light in all directions. In strong sunlight this solution, however, still produces too much glare. A scattering surface also reduces the transparency of the window so that it is useless for viewing through.

Another solution to reduce glare has been to have redirecting surfaces in all or part of the window, redirecting some of the incident light towards the ceiling of the room, e.g. by arranging prisms inside the window. Prism structures for light redirection are well known as well as a double rotating prism structure for optimal light redirection of (time varying) direct sunlight, see e.g. U.S. Pat. No. 5,729,387. Using prisms also reduce or destroy the ability to see through the window, affecting the function of the window to view through. Another problem using prisms inside the window is that the illumination of the ceiling will change as the sun angle shifts during the day if not active movement of the prisms is achieved to follow the sun movements.

Some rooms in a building are so large that light from windows do not reach all parts, and some rooms deep inside buildings does not have any walls to the outside to let daylight in through. In these cases systems have been developed to use optical fibres or light ducts to transport light deep into the building. A light duct is a pipe having strongly reflective inner walls. A system of light ducts is for example shown in the source book "*Daylight In Buildings*" published by the International Energy Agency (IEA). In these systems the collecting side of the duct is often equipped with collecting optics, often placed in a favourable angle to the sun. The collection systems are, however, bulky and not favourable from an esthetical point of view, leading to a resistance to them from architects. The bulky construction may also be in the way of other equipment wanted on the building.

There is thus a need to have a more efficient way of directing daylight into buildings through windows and light ducts in an efficient way while keeping cost down and producing a solution that is attractive or discrete enough so that people, and especially architects, want to use them.

SUMMARY OF THE INVENTION

It is an object of the present invention to improve the current state of the art, to solve the above problems, and to provide an improved device for redirecting and focusing daylight into buildings. These and other objects are achieved by a light redirection device for redirecting and concentrating direct sunlight, that for instance can be transported deep into buildings, said device comprising at least one transparent element having a substantially planar top surface in an x-y-plane and a substantially planar bottom surface, wherein said top and bottom surfaces are arranged in an angle $\alpha$ to each other around the x-axis, and a light reflector for each transparent element having a planar surface, wherein said planar surface of said light reflector is arranged substantially parallel and adjacent said bottom surface of said transparent element, wherein said reflective surface is spaced apart from said transparent element by a transparent medium having lower refractive index than the transparent element, so that incident light to the device is refracted by each material transition interface and reflected by the specular reflecting surface. Incident light is thus transported through the transparent element and is refracted by the bottom surfaces of the transparent element, is transported through the transparent medium, is reflected by the reflective surface, is transported through the transparent medium and is transported through and is refracted by the surfaces of the transparent element. The material transition interface is for example an air-dielectric transition from the gap between the reflective medium and the transparent element to the transparent element.

By providing the redirection device with four occurrences of refraction, i.e. two for each way it passes through the transparent element, and one reflection in the reflecting element, incident light is deviated a lot from the incident angle making it possible to make a horizontal planar device and direct incident vertical daylight into an almost horizontal direction. The redirected light is also focused in that the redirected light has a smaller cross section area than the incident light and the top area of the redirection device, The arrangement also makes the output angle of light very insensitive to the incident angel variation of the sun during the day.

When for example having the device at the upper part of a window as a shading plate, incident light can be redirected towards the ceiling of the room inside the window illuminating in substantially the same way all day, despite variations in the angle of incident light due to sun movement. The device is also possible to make very thin, since the transparent elements and the light reflectors can be made small and in great numbers in rows. In the horizontal direction of the window surface, the transparent elements and light reflectors, respectively, may be as long as the redirecting device. Since the transparent elements and light reflectors are placed in rows it is understood that incident light that is transported through one transparent element and reflected in a light reflector, may be transported through a transparent element in the next row.

For the proposed device to work as described above it is understood that the angle $\alpha$ has to be small enough so that the rays exit through the top side of the transparent element. It also has to be considered that the direct sunlight angle will not only vary around the x-axis, but also around the y-axis, why the exact angles will be an optimization depending on latitude of the intended place of use and in what direction (south, west etc) that the y-axis of the device described above is mounted. It is thus likely to have a number of different models of the device according to the invention for different geographic markets and for different mounting positions regarding the direction of the y-axis.

Daylight collection and transport can be performed via total internal reflection (TIR) in optical transparent media or via specular reflective metal surfaces as proposed in the device of the current invention. Reflective surfaces benefit over TIR as they transport a substantially larger part of the diffuse light, as daylight. In addition, due to its nearly flat spectral absorption the colour temperature of the transported light remains very close to that of daylight and as a result increases the impression of connectivity.

Since the redirecting device is possible to make thin and since it has a form of a plate or sheet, it is discrete enough to be attractive to use without affecting the outer design of the building it is attached to as much as the prior art technique. It is thus preferable to make the plate as thin as possible, while still keeping stability in the structure, for example from a few millimetres to a few centimeters in thickness.

The spacing between the reflecting surface and the transparent element is preferably sealed to avoid getting dirt in the space and is filled with a transparent medium has a refractive index of 1.1 or lower. The transparent medium is preferably a gas as for example air or nitrogen, but could also be vacuum. The transparent medium may be any medium having a lower refractive index than the transparent element. The light redirecting and concentrating device described preferably comprises multiple transparent elements and corresponding light reflectors placed in rows having their top surfaces in the same geometrical plane. The top surface may then be manufactured having a joint top surface. The transparent element may be a triangular prism, or a triangular prism being truncated in its pointy end.

The angle $\alpha$ is chosen to create the desired overall redirection of light using the device and may for example be between 7 and 27 degrees, preferably between 12 and 22 degrees. The exact direction chosen is dependent on the latitude of building the device is intended to be mounted to. It is also possible to have optimized versions of the device depending on the direction its x-y-plane will be mounted, i.e. what wall of the building.

The transparent element is preferably transparent to visible light, e.g. light in the region from 300 nm to 1000 nm. If a different colour of the directed light is desired, the transparent element may be made of a material that is transparent to the desired radiation region for the illumination colour.

The transparent element may have a refractive index in the range of 1.3 to 1.7, preferably in the range of 1.4 to 1.6, and is preferably made of glass or a plastic material. The prismatic structure of the joint reflective indexes forming a plate-like upper piece of the device having structures on the bottom side, may for example be moulded or cut out from a plate using laser to produce the correct structure according to the description above.

Since the light is refracted four times in the edges of the transparent element, losses of light will occur due to Fresnel losses, normally around 4% in each refraction. This sums up to a possible loss of 16% of the light due to refraction. To reduce these losses the surfaces, or at least one of the surfaces, of said transparent element may be coated with an antireflective coating. The antireflective coating is preferably optimized for grazing transmittance angles.

The reflecting element of the proposed device is a mirror for visible light. The light reflector is also preferably manufactured in one piece in a similar way as the transparent piece. The light reflector, however has to have its structured side, the upper side facing the transparent element, produced so that it is reflective for all light radiation wavelengths that are to be redirected by the device. This can be made by coating that surface with a highly reflective material, for example a metal like aluminium, or silver or any other reflective metal or metal alloy. It can also be achieved by making the entire light reflector of a highly reflective material.

The x-y plane, of the upper surface of the transparent element is preferably substantially equal to the horizontal plane to be esthetical when mounted on a building wall. The shape of the structure of the bottom side of the light reflector is not important for the invention, but is preferably also flat to give the entire device the look of a plate, film or sheet having parallel flat surfaces.

Light redirected using a mounted device according the invention may direct light onto the ceiling in a room inside a window outside which it is mounted. It may, however, also redirect light into a light duct placed in the y-direction of said planar top surface. The light duct may be a cylindrical pipe with arbitrary cross section having a reflective inner surface. The light duct may transport light deeper into a building than is practically possible with a window. Since the redirected light from the redirecting device according to the above has a substantially constant output angle during the day, the light distribution from the light duct will be substantially constant during the day, as long as the daylight is fairly constant. As the transport in the light duct is not based on wave-guiding through dielectric media, as in other solutions for light transportation (for example optical fibres), this solution does not result in spectral absorbance that in turn would change the colour rendering and colour temperature of the daylight.

The present invention further relates to a method for redirecting and concentrating direct sunlight into buildings, using a device according to the above description, wherein the method comprises the step of arranging said device substantially horizontally, having one of its edges adjacent a building wall or window. The method may further comprise the step of arranging a horizontal light duct in said building wall or window so that its collecting opening collects light that is redirected by the device, and so that light leaving the end of the light duct illuminates the inside of a building.

It is understood that the same advantages are achieved by the inventive method as are achieved by the device discussed above.

According to one embodiment of the present invention the method further comprises the steps of arranging the device pivotably against said wall or window, and adjusting the angle of the device top surface towards the wall or window to follow the angle of the sun, thereby optimizing the amount of light that is redirected by the device at each time.

Although the device according the invention is constructed to redirect daylight substantially in the same direction independently of the position of the sun and thus the angle of incident light, it might be preferred in some cases to still pivot the plate some to follow the sun movement. This might e.g. be wanted if light is redirected using the device into a very narrow light duct or passage or if the light direction device is used for other reasons as for example to project light onto photo voltaic elements.

The proposed collecting system may, as described above, redirect the light into an efficient light duct for further transport into the building or distribute the light via a window directly into a room. In the first case one has to optimize the redirection for further transport, meaning redirect the rays parallel to the duct direction as much as possible. The optimization is performed by adjusting the angle $\alpha$. In the second case, the light has to be redirected such that the light distribution in the room is optimal, i.e. minimized hot spots or glare effects. This leads to a very different ray redirecting than the first case. The exact shape of the surface pattern on the transparent element as well as the reflector can be optimized to fulfil such different requirements.

The planar surfaces of the transparent surfaces and the light reflector may also be made slightly curved or randomly distorted to reduce glare when the light direction device is used for illumination of a ceiling directly inside a window.

The optimal orientation of the re-directional structure building up the plate or redirecting device according the invention highly depends on the location on the globe. In northern countries the orientation may be that the device is parallel to the façade (hence like a window). In that case an additional mirror would be needed to reflect the directed light inside a building. A key element of the invention is that the direct sun light is concentrated onto an area that is smaller than the redirectional plate in which a large variation in solar positions are still accepted.

It should be noted that the inventive method may incorporate any of the features described above in association with the inventive device and has the same corresponding advantages.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF THE EMBODIMENTS

Figure 1A:
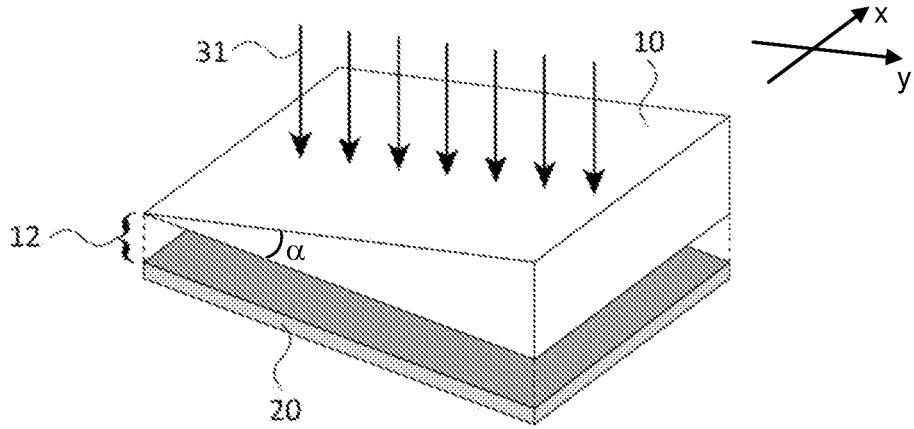
FIG. 1*a* is a perspective view of the principle of the invention having one transparent element and one light reflector.

In the various Figs. of the drawing identical parts are always given the same reference number so that they are generally only described once in the detailed description below.

Figure 1B:
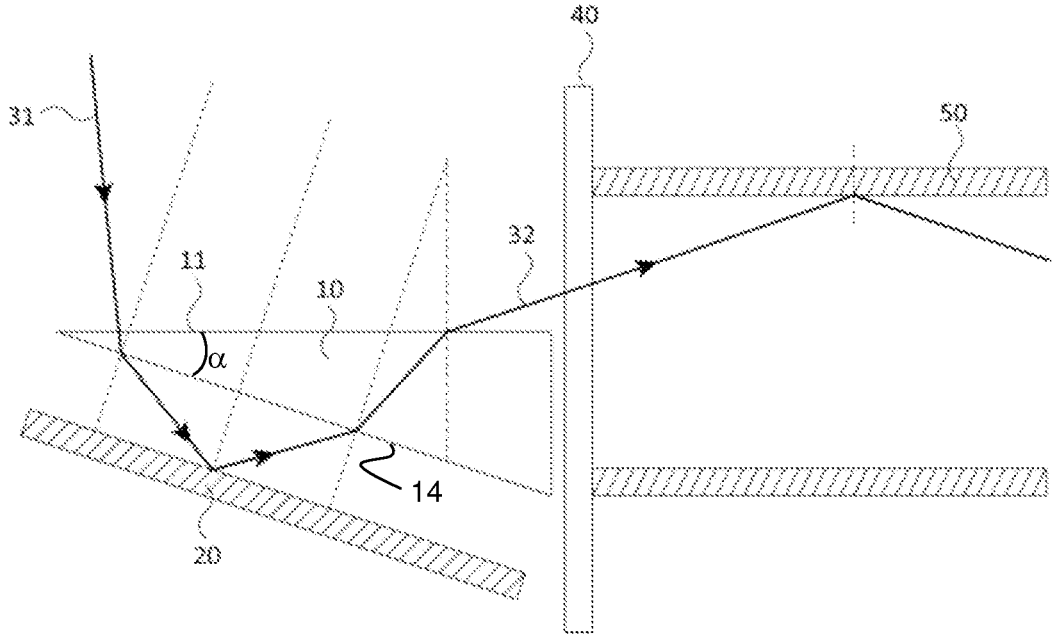
FIG. 1*b* is a cross sectional view of a simple device according to the invention placed by a light duct, showing the principle of the light path in the device according to the invention.

FIG. 1*a* and FIG. 1*b* shows the principle of the device according to the invention having one transparent element 10 and one light reflector 20. The light reflector 20 is arranged at a side of the triangular prism or transparent element 10 opposite from a light receiving side 11. The triangular prism has an angle $\alpha$ between its top (11) and bottom (14) surfaces. The reflective element 20 is parallel to the bottom surface of the prism.

The light reflector 20 may be in optical contact with the triangular prism 10, but is preferably spaced a certain distance 12 away from the triangular prism 10 to achieve an additional refraction. When collimated light 31 is incident on the light receiving side 11 of the triangular prism 10, it is first refracted towards the light reflector 20, reflected back into the prism 10 and then refracted again, resulting in an overall redirection of the incident light. The redirected light 32 can be transported, for example, via a transparent window 40 and a further light reflector 50, for example a light duct, into a room of a building. The light collection and redirection structure preferably comprises a plurality of triangular prisms and reflectors, and it can be provided in the form of a flat plate or foil.

Figure 2:
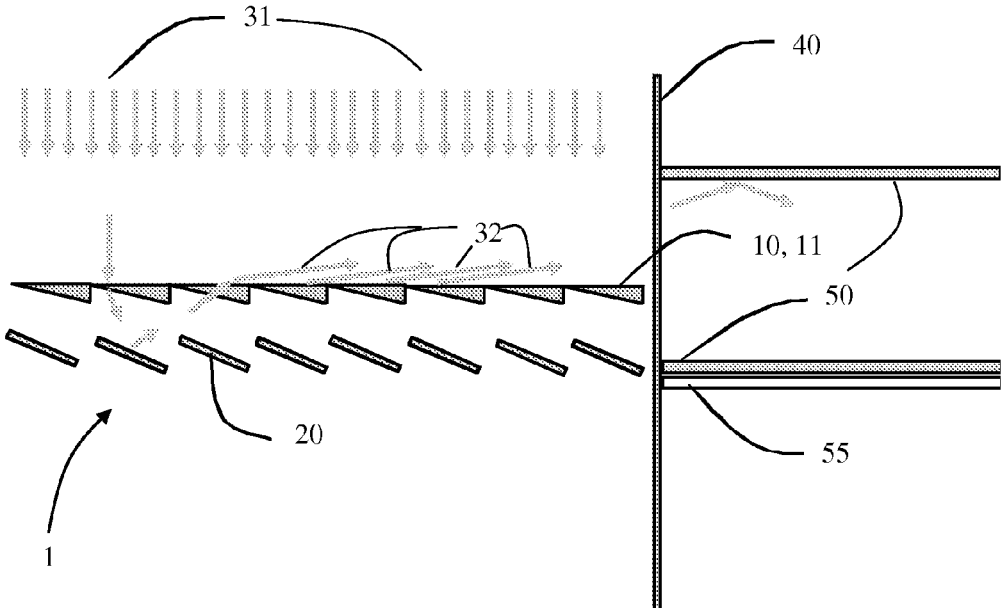
FIG. 2 is a schematic cross sectional view of the device according to the invention placed by a light duct inside a room window.

In FIG. 2 the invention is shown having multiple transparent elements 20 in the form of prisms formed as a thin sheet, or plate, or foil. The prisms have a refractive index typically between 1.4 to 1.6. The incident direct sun rays 31 travel through the upper cathetus of the prism and are then redirected by the prism hypotenuse, subsequently by the reflective mirror, by the prism hypotenuse again and finally by the dielectric's cathetus. These four redirections ensure a large deviation of the angle of the incident light and makes the output light direction 32 insensitive to sun movements. In FIG. 2 the ray reflected by the mirror is redirected by a second prism neighbouring structure. However, this is solely for the sake of graphic visualization. The reflected ray 32 may be redirected by any prism structure including the prism through which it was transmitted in the first place. The prism through which the reflected ray (by the mirror) is redirected will be generally determined by the distance between the mirror and the prism array. Ultimately, the complete structure is integrated into a thin planar geometry and the distance between the reflector and the prism is thus kept very small, just enough to ensure no contact between the reflector and the prism so that the desired refractions occur.

In FIG. 2 the redirected rays 32 are directed into a light duct having reflective inner walls 50, above the ceiling of a room 55. The window 40 will let daylight into the room and redirected direct sunlight 32 into the light duct.

Figure 3A:
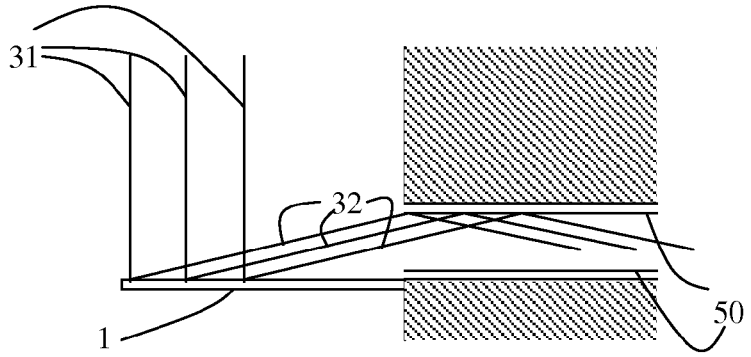
FIGS. 3*a-c* show the principle of the device according to the present invention for incident daylight of different angles at different times of the day.
Figure 3B:
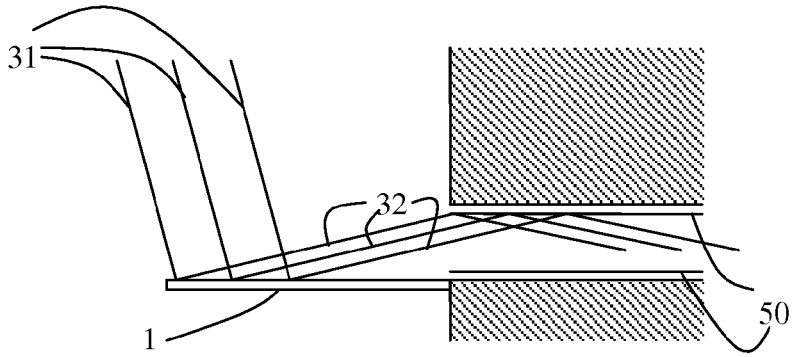
Figure 3C:
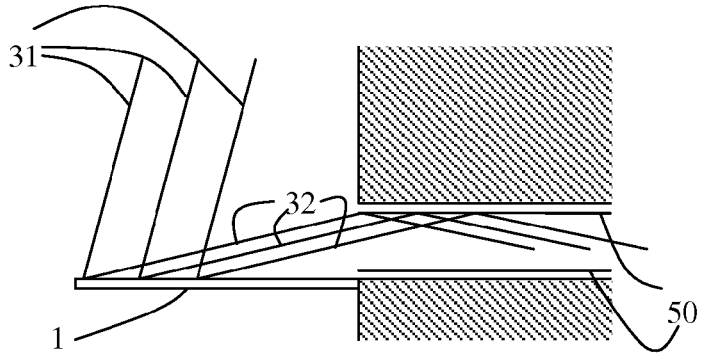

The surface structured redirecting device effectively reduces the angular variation in reflectance over a large range of incident angles. In case one uses solely a plane reflective mirror the angular variation of incidence equals the angular variation in reflectance. The multi stage redirection thus has the advantage that it is resilient against changes in angle of incidence as shown in FIGS. 3*a-c*. In FIGS. 3*a-c* the ray redirection is shown for three different angles of the incident light, showing that the output direction of the light is not very much affected by the variation. The three examples in FIGS. 3*a-c* represent the effect of sun movement on the incident daylight during office hours. The direct sun rays are concentrated and redirected into a small opening in the facade. The moments of collection during the day are meant to illustrate noon, morning and afternoon.

Fresnel losses have not been included in the graphic representation in FIGS. 1-3. For a medium with refractive index 1.5 at normal incidence the Fresnel loss yields 4%. As there are four dielectric-air transitions the minimal Fresnel loss is 16%. An anti-reflective (AR) coating (not shown) optimized for grazing transmittance angles may therefore be added to the surface of the prisms above to reduce these losses.

It is understood that other variations in the present invention are contemplated and in some instances, some features of the invention can be employed without a corresponding use of other features. It may e.g. be considered fixing the specular reflective mirrors onto rotating blades, i.e. lamellae structures to follow sun movements. In principle, both the surface structure of the transparent element as well as the light reflector can be designed onto foils. This allows the optical assembly to be integrated into an awning structure.

In the Figs., the device according to the invention is visualized at a facade, but the planar structure may also be placed onto a roof near a vertical transparent opening connected to a room, such as dormer, skylight with a dome.

As briefly mentioned, it is also possible to alter the planar surfaces of the prismatic transparent element and/or the light reflector to reduce glare in the light that has been redirected by the inventive device and method.

The device according to the invention may thus also be used as an optical concentrating and redirecting tool in combination with photovoltaics.

Accordingly, it is appropriate that the appended claims be construed broadly in a manner consistent with the scope of the invention.

The invention claimed is:

1. A device comprising:

a transparent element having a substantially planar top surface in an x-y-plane defined by an x-axis and a y-axis and a substantially planar bottom surface, wherein the top and bottom surfaces are arranged in an angle $\alpha$ with respect to each other around the x-axis, and a light reflector having a reflective surface, wherein the reflective surface comprises a material which is reflective for visible light, and wherein the reflective surface is arranged substantially parallel and adjacent to the bottom surface of the transparent element, wherein the reflective surface is spaced apart from the transparent element by a transparent medium having a lower refractive index than the transparent element, so that direct sunlight incident on the substantially planar top surface of the transparent element is refracted by each material transition interface and reflected by the light reflector.

2. The device of claim 1, wherein the transparent medium has a refractive index of 1.1 or lower.

3. The device of claim 1, wherein the transparent element is a triangular prism.

4. The device of claim 1, wherein the angle$\alpha$ is between 7 and 27 degrees.

5. The device of claim 1, wherein the transparent element is transparent to visible light.

6. The device of claim 1, wherein the transparent element is transparent to light in the region 300 nm to 1000 nm.

7. The device of claim 1, wherein the transparent element has a refractive index in the range of 1.3 to 1.7.

8. The device of claim 1, wherein at least one of the surfaces of the transparent element is coated with an antireflective coating optimized for grazing transmittance angles.

9. The device of claim 1, wherein the reflecting element is a mirror for visible light.

10. The device of claim 1, further comprising a light duct disposed in the y-direction of the planar top surface.

11. The device of claim 10, wherein the light duct is a cylindrical pipe with arbitrary cross section having a reflective inner surface.

12. The device of claim 1, wherein the reflective surface of the light reflector is parallel to the bottom surface of the transparent element and wherein the transparent medium comprises one of: air, nitrogen, and a vacuum.

13. The device of claim 1, wherein the angle $\alpha$ and a distance by which the reflective surface is spaced apart from the transparent element are configured such that the direct sunlight incident on the substantially planar top surface of the transparent element is reflected by the light reflector so as to pass back through the transparent element.

14. A method for redirecting and concentrating direct sunlight into buildings, comprising:

providing a device, comprising;

a transparent element having a substantially planar top surface in an x-y-plane defined by an x-axis and a y-axis and a substantially planar bottom surface, wherein the top and bottom surfaces are arranged in an angle $\alpha$ with respect to each other around the x-axis, and a light reflector having a reflective surface, wherein the reflective surface comprises a material which is reflective for visible light, and wherein the reflective surface is arranged substantially parallel and adjacent to the bottom surface of the transparent element, wherein the reflective surface is spaced apart from the transparent element by a transparent medium having a lower refractive index than the transparent element;

arranging the device with the substantially planar top surface of the transparent element substantially perpendicular to direct sunlight at noon, with one of its edges adjacent a building wall or window of a building;

the substantially planar top surface of the transparent element receiving direct sunlight;

each material transition interface of the device refracting, and the light reflector reflecting, the received direct sunlight to redirect and concentrate the direct sunlight into the building.

15. The method of claim 14, further comprising arranging a horizontal light duct in the building wall or window so that a collecting opening of the horizontal light duct collects light that is redirected by the device, and so that light leaves an end of the horizontal light duct and illuminates the inside of a building.

16. The method of claim 14, wherein each material transition interface of the device refracting, and the light reflector reflecting, the received direct sunlight to redirect and concentrate the direct sunlight into the building comprises the light reflector reflecting the received direct sunlight so as to pass back through the transparent element and then into the building.

17. A device, comprising:

a plurality of transparent elements each having a substantially planar top surface in an x-y-plane defined by an x-axis and a y-axis and a substantially planar bottom surface, wherein the top and bottom surfaces are arranged in an angle $\alpha$ with respect to each other around the x-axis, and wherein the top surfaces of the plurality of transparent elements are in a same geometrical plane as each other; and a plurality of light reflectors, each of the light reflectors corresponding to one of the plurality of transparent elements and having a reflective surface, wherein the reflective surface comprises a material which is reflective for visible light, and wherein the reflective surface is arranged substantially parallel and adjacent to the bottom surface of the corresponding transparent element, wherein the reflective surface of each of the light reflectors is spaced apart from its corresponding transparent element by a transparent medium having a lower refractive index than the transparent element, so that direct sunlight incident on the substantially planar top surfaces of the transparent elements is refracted by each material transition interface and reflected by the light reflectors.

18. The device of claim 17, wherein the angle $\alpha$ is between 7 and 27 degrees.

19. The device of claim 17, wherein the plurality of light deflectors are aligned in a direction along the y axis.

20. The device of claim 17, wherein the angle $\alpha$ and a distance by which each reflective surface is spaced apart from the corresponding transparent element are configured such that the direct sunlight incident on the substantially planar top surfaces of the transparent elements is reflected by the light reflector so as to pass back through one or more of the plurality of transparent elements.

* * * * *